United States Patent [19]

Scheithauer, Jr. et al.

[11] 3,964,878

[45] June 22, 1976

[54] CEMENTED CARBIDE EMPLOYING A REFRACTORY METAL BINDER AND PROCESS FOR PRODUCING SAME

[75] Inventors: William Scheithauer, Jr., Athens; Glenn Albert Shaffer, Towanda, both of Pa.

[73] Assignee: GTE Sylvania Incorporated, Stamford, Conn.

[22] Filed: June 6, 1973

[21] Appl. No.: 367,433

[52] U.S. Cl. ..... 29/182.7; 29/182.8; 75/203; 75/204; 75/212; 75/221

[51] Int. Cl.[2] ..... C22C 1/06; B22F 3/16; C22C 29/00

[58] Field of Search ..... 29/182.7, 182.8; 75/203, 204, 212, 221

[56] References Cited

UNITED STATES PATENTS

| | | | |
|---|---|---|---|
| 2,011,369 | 8/1935 | McKenna | 29/182.8 |
| 2,246,387 | 6/1941 | Schwarzkopf | 29/182.7 |
| 2,313,227 | 3/1943 | DeBats | 29/182.8 X |
| 3,147,542 | 9/1964 | Boeckeler | 29/182.8 X |
| 3,488,291 | 1/1970 | Hardy et al. | 29/182.8 X |
| 3,676,084 | 7/1972 | Quatinetz | 29/182.8 X |
| 3,737,289 | 6/1973 | Rudy | 75/204 X |
| 3,737,290 | 6/1973 | Frehn | 29/182.8 X |

OTHER PUBLICATIONS

Schwarzkopf, P. et al., *Cemented Carbides*, MacMillan, N.Y., 1960, pp. 32–47.

Goetzel, C. G., Treatise on Powder Metallurgy, vol. II, Interscience, N.Y., 1950, pp. 94–95.

*Primary Examiner*—Richard E. Schafer

*Attorney, Agent, or Firm*—Norman J. O'Malley; Donald R. Castle; William H. McNeill

[57] ABSTRACT

A cemented carbide composition is disclosed that consists essentially of a carbide of a refractory metal selected from Group 4, Group 5, and Group 6 metals and mixtures thereof and a binder selected from one of the foregoing refractory metals and from 0.5 to 1.5% by weight of an iron group metal. A process for producing these materials is also disclosed which comprises forming an intimate admixture of the desired refractory metal carbide, the desired refractory metal, an iron group metal, a paraffin wax and a volatile mixing aid. Thereafter, the mixing aid is removed by heat. The resulting powder particles are compacted to a predetermined shape and heated at a temperature sufficient to remove the wax and thereafter are heated at a temperature above the melting point of the catalyst and thereafter elevated in temperature to achieve suitable sintering.

9 Claims, No Drawings

CEMENTED CARBIDE EMPLOYING A REFRACTORY METAL BINDER AND PROCESS FOR PRODUCING SAME

BACKGROUND OF THE INVENTION

1. Field of the Invention

This invention relates to cemented carbides, particularly in use in cutting tools. More particularly, it relates to a carbide having high strength at elevated temperatures.

2. Prior Art

Iron, nickel or cobalt are the binders used in conventional carbides that are used in cutting tools. These materials have good strength at lower temperatures and a high toughness. However, because of the low melting, relatively soft, ductile binders at elevated temperatures wear is high, deformation occurs and some thermal cracking occurs.

Attempts have been made in the past to employ Group 4, Group 5 and Group 6 metals as the binder, however, these materials suffered from high porosity and some segregation of materials therein. Fusion metallurgy led to materials having erratic tool life, also because of segregation and porosity.

It is believed, therefore, a material which does not have high porosity and is uniform throughout which employs a refractory metal as a binder would be a definite advance in the art.

OBJECTS AND SUMMARY OF THE INVENTION

It is an object of this invention to provide an improved cemented carbide.

It is a further object of this invention to provide a cemented carbide which is particularly adapted for cutting tools operating at high temperatures.

It is an additional object of this invention to provide a cemented carbide employing a binder of refractory metal.

It is an additional object of this invention to provide a cemented carbide consisting essentially of a refractory metal carbides selected from the Group 4, Group 5 and Group 6 carbides and mixtures thereof and a binder of the refractory metal previously mentioned Groups of metals and from about 0.5 to about 1.5% by weight of an iron group metal.

It is an additional object of this invention to provide a process for producing a cemented carbide employing a refractory metal as a binder.

These above objects as well as other objects are achieved in one embodiment of this invention by providing a cemented carbide composition consisting essentially of from about 15 to 50% by weight of a refractory metal carbide selected from the carbides of the metals of the Groups 4, 5, and 6 metals and from 50 to 85% of a binder selected from a Group 4, 5, or 6 metal and from 0.5 to 1.5% by weight of an iron group metal. The foregoing compositions are made by additional embodiment of the invention by forming an admixture of a refractory metal carbide, a refractory metal, a wax, an iron group metal and a volatile mixing aid; volatizing said mixing aid; compacting the resulting powder to a predeterming shape; heating the shapes to remove the wax; elevating the temperature sufficient to melt the an iron group metal; and thereafter additionally elevating the temperature for a sufficient time to achieve sintering.

DETAILS OF THE PREFERRED EMBODIMENTS

For a better understanding of the present invention, together with other and further objects, advantages and capabilities thereof, reference is made to the following disclosure and appended claims in connection with the above description of some of the aspects of the invention.

In the practice of this invention, the solids include the refractory metal carbide, the refractory metal, the catalyst and a paraffin wax which is used to bind the particles together in the subsequent pressing step. The liquid which is used in the initial mixing step is a mixing aid.

The refractory metal carbides which are employed include the carbides of the Group 4 metals, Group 5 metals, and the Group 6 metals. Although any of these can be used, it is preferred to use titanium carbide and zirconium carbide from the carbides of the Group 4 metals; vanadium carbide and tantalum carbide from the carbides of the Group 5 metals; and chromium carbide, molybdenum carbide and tungsten carbide of the carbides of the Group 6 metals. Mixtures of the foregoing refractory metal carbides can also be used as well as solid solutions of two carbides such as for example, a solid solution containing 50% by weight tungsten carbide and 50% by weight of titanium carbide solid solution. The amount of carbide that will be employed is from about 25 to 50 percent of the total solvents.

The refractory metal binders which can be used are any of the refractory metals of the Group 4, Group 5, and Group 6 metals heretofore mentioned. Tungsten is the preferred refractory metal binder because of its high melting point. It therefore offers the higher strength material at the elevated temperatures, although any of the refractory metals used as a binder offers an improvement over the conventional carbides employing either nickel, cobalt or iron.

The an iron group metal that is preferred is nickel although iron and cobalt can also be used if desired. The level of an iron group metal used is from about 0.5 to 1.5% by weight of the cemented carbide.

The amount of refractory metal binder that will be used is generally from 50 to 85% of the total solids This is higher than the normal amount of binders used in the conventional cemented carbides, however, because a refractory metal material is used, it offers hgher strength than the conventional carbide.

Paraffin wax is preferred to coat the particles during the mixing step which is required to yield a uniform admixture. Thereafter when the volatile mixing aid is evolved, the paraffin wax will tend to allow the individual powder particles to be bound together to form a desired geometric shape. Any wax can be used that can be removed below the melting point of the iron group metal.

The mixing aid that is used is a liquid at the milling temperatures normally employed and aids in achieving a uniform mixture. Hexane is preferred material, however, other materials which can be evolved at about 50° to 120°C are suitable. Generally, about 1 part of mixing aid to one part of solids is used, although this can vary from about 1:2to about 2:1 weight ratio.

Ball milling is generally the preferred method of achieving a uniform admixture of the solids. During ball milling, the particles sizes are reduced to a considerable degree. After ball milling which is generally conducted for about 24 hours, although longer times can be used if desired, the resulting slurry is screened through a 200 mesh screen. Thereafter, the powder is dried and the powders are mechanically pressed or isostatically pressed at pressures from 10 to 60 pounds per square inch to produce a desired shape. After shaping the particles by pressing, the shapes are put into a vacuum furnace and the temperature is raised to between 200° and 350°C to remove the wax which has been used to bind the individual particles together. Generally from 4 to 24 hours is sufficient to remove the wax. Thereafter, the temperature is increased to above the melting point of the iron group metal. For example, if nickel is used, it is raised from about 1475°C to about 1550°C and thereafter holding that temperature for sufficient time to insure the nickel is in the liquid phase. The temperature is thereafter raised to the sintering temperature which will vary somewhat depending upon the particular carbides and refractory metal binder that is used. About 1850°C to 1950°C is generally sufficient. The material is held at that temperature for an additional 1 to 1½ hours to insure that the particles are sintered together to form a non-porous mass.

To more fully illustrate the subject invention, the following detailed examples ar presented. All parts, percentages and proportions are by weight unless otherwise indicated.

EXAMPLE I

About 40 parts of tungsten titanium carbide which is a solid solution of 50% by weight of tungsten carbide and 50% by weight of titanium carbide, about 28 parts of tunsten carbide, about 132 parts of tungsten and about 2 parts of zirconium carbide are mixed with 2 parts of nickel and 2 parts of paraffin wax to form the solids which are charged into a ball mill containing about 230 parts of hexane. The ball mill is run for about 24 hours and thereafter the slurry is dried to remove the hexane and the dried powders which are free flowing are screened through a 200 mesh screen. The material which passes through the 200 mesh screen is isostatically pressed at 20 kilograms per square inch to form a desired shape. The shapes are charged into a vacuum press which is operated at 200° to 350°C for about 24 hours to fully de-wax the materials. The temperature is thereafter increased to about 1500°C over a period of 1 hour and held at that temperature for an additional hour. Thereafter, the temperature is raised to 1900°C within an hour and held at that temperature for an additional 1½ hours. Samples of the material and used to conduct standard laboratory tests indicate that the density is 14.14 grams/cc, the hardness is 88.1 on the Rockwell A scale, and the transverse rupture strength is 114,600 pounds/sq. inch. Field tests on railroad wheels indicate that the refractory metal binder carbide yields good results on heavy roughing cuts when tools are run hot and are far superior in wear resistance to conventional cobalt binder carbides It is not recommended or intended that such refractory metal binder carbides would be used in those instances where a lubricant or coolant is supplied during the cutting. The test shows that as compared to a conventional cobalt binder tungsten carbide, the refractory metal binder carbide produced by this example will achieve about 2 times the amount of grinding that the cobalt binder carbide will achieve.

While there has been shown and described what are at present considered the preferred embodiments of the invention, it will be obvious to those skilled in the art that various changes and modifications may be made therein without departing from the scope of the invention as defined by the appended claims.

What is claimed is:

1. A cemented carbide composition consisting essentially of from about 15 to about 50 percent by weight of a refractory metal carbide selected from carbides of refractory metals of the Group 4, Group 5, and Group 6 metals and mixtures thereof, from about 50 to about 85 percent of a binder selected from said refractory metals and from about 0.5 to about 1.5% of an iron group metal selected from iron, nickel and cobalt.

2. A composition according to claim 1 wherein said iron group metal is nickel.

3. A composition according to claim 2 wherein said refractory metal carbide is selected from titanium carbide, zirconium carbide, chromium carbide, molybdenum carbide, tungsten carbide, vanadium carbide, tantalum carbide and mixtures thereof.

4. A composition according to claim 3 wherein said refractory metal binder is tungsten.

5. A composition according to claim 4 wherein said refractory metal carbide is a solid solution of tungsten carbide and titanium carbide.

6. A process for producing a cemented carbide composition comprising:

a. forming an admixture by suitable mixing of refractory metal carbide, a refractory metal, a wax, an iron group metal, and a volatile mixing aid; said refractory metal carbide being from about 15 to about 50%, said refractory metal being from about 50 to 85% and said iron group metal being from about 0.5 to about 1.5%, said percentages being based upon the weight percent of the combined total weight of said carbide, said refractory metal and said iron group metal;

b. removing said mixing aid;

c. compacting the resulting powder to a predetermined shape;

d. heating said shapes at a first temperature for a sufficient time to remove said wax;

e. heating said shapes at a second temperature above the melting point of said iron group metal for at least about two hours; and thereafter f. heating said shapes at a sintering temperature from about 1850°C to about 1950°C for a time sufficient to achieve complete sintering of the resulting particles.

7. A process according to claim 6 wherein said iron group metal is nickel and said first temperature is from about 200°C to about 350°C.

8. A process according to claim 7 wherein said second temperature is from about 1475°C to about 1550°C.

9. A process according to claim 8 wherein said mixing aid is hexane.

* * * * *

UNITED STATES PATENT AND TRADEMARK OFFICE

CERTIFICATE OF CORRECTION

PATENT NO. : 3,964,878

DATED : June 22, 1976

INVENTOR(S) : William Scheithauer, Jr. and Glenn A. Shaffer

It is certified that error appears in the above-identified patent and that said Letters Patent are hereby corrected as shown below:

Col. 2, lines 10 & 11 - Delete "the catalyst" and insert -- an iron group metal --.

Col. 2, line 47 - Delete "hgher" and insert -- higher --.

Col. 3, line 24 - Delete "ar" and insert -- are --.

Signed and Sealed this

Seventh Day of September 1976

[SEAL]

*Attest:*

RUTH C. MASON
*Attesting Officer*

C. MARSHALL DANN
*Commissioner of Patents and Trademarks*